United States Patent [19]

Beatović et al.

[11] 4,342,609

[45] Aug. 3, 1982

[54] EXPLOSION METHOD OF FINISHING WELDED JOINTS

[76] Inventors: Branislav P. Beatović, Tome Meje No. 26; Stevan L. Kuzmanović, Moše Pijade No. 28, both of 41000 Sarajevo, Yugoslavia; Vladimir M. Kudinov, Filatova No. 1, Kiev 42; Vladimir G. Petuškov, Jerevanska No. 14, Kiev 87, both of U.S.S.R.

[21] Appl. No.: 114,554

[22] Filed: Jan. 23, 1980

[30] Foreign Application Priority Data

Jan. 26, 1979 [YU] Yugoslavia ..... 178/79

[51] Int. Cl.[3] ..... C21D 1/00

[52] U.S. Cl. ..... 148/127; 228/125; 148/4

[58] Field of Search ..... 228/125, 107–109; 148/4, 127

[56] References Cited

U.S. PATENT DOCUMENTS 3,261,088 7/1966 Holtzman ..... 228/108

3,263,324 8/1966 Popoff ..... 228/108

3,732,612 5/1973 Simon ..... 228/10 8

FOREIGN PATENT DOCUMENTS 619528 8/1978 U.S.S.R. ..... 228/125

*Primary Examiner*—Gus T. Hampilos

*Assistant Examiner*—K. Y. Lin

[57] ABSTRACT

A method is described reducing remaining tensions and corrosion resistance in welded joints by explosion finishing thereof, comprising disposing over the axis of the weld seam an explosive charge in the form of a periodic curve, the axis of which is substantially co-extensive with that of the weld seam with the amplitude thereof extending from one side of said seam to the other, and then detonating said explosive charge. In one embodiment an auxiliary explosure charge is disposed substantially linearly over the axis of the weld seam to assure complete detonation of the charge disposed in the form of a periodic curve and comprising the main charge, and then both charges are simultaneously detonated.

2 Claims, No Drawings

EXPLOSION METHOD OF FINISHING WELDED JOINTS

The invention relates to the explosion method of metal finishing. It is superbly efficient for lowering the remaining tensions caused by welding. Also, it is useful for increasing resistivity to corrosion of welded joints of steel structures in chemical, processing, metallurgical, machine building and other industries.

Currently known methods of reducing the remaining tension in welded joints have been carried out only through thermal processing such as annealing. The annealing of welded structures is effected either fully or locally i.e. seam and surrounding zone. For annealing complete structures it is imperative to have available ovens of adequate dimensions; local annealing gives only partial results which often do not meet necessary standards.

Costs of annealing large size welded structures sometimes exceed the value of all other operations on the structure. Technical conditions of performing annealing on the work site sometimes are so risky that such a procedure has to be abandoned. Such conditions have created a need for research aimed at new, non-thermal procedures of reducing tension.

Known is a method of increasing resistance to wear in welded joints, through strenthening the welds by use of an explosion on the seam area and surrounding zone.

Explosion material line fillings are placed along the axis of seam integration with basic metal (Trufjakov V.I.: "Ustalost svarnih soedinenij", Kijev, Naukova dumka, 1973). A shortcoming of this well-known method is its low efficiency in increased the corrosion-mechanical resistivity of welded joints: it does not make possible lowering of the remaining welding tensions to the level necessary to achieve corrosion stability of the structure. In addition to this, the known mode does not make feasible lowering of remaining tensions in the entire zone of the welded seam.

The purpose of the present invention, is to detail a method of using an explosion for finishing welded joints of steel structures, thus opening the door to an efficient lowering of welding tensions and to provide finishing of the entire zone of the weld to reduce remaining tensions.

The solution is based on in line with the weld a placing continuous explosive charge, the charge consisting of one or more parts.

The explosive charge so placed is disposed over the weld in the form of a periodic curve e.g. a sinusoid, trapeze, triangle or, rectangular shape.

The charging is effected in the following manner:

The main explosion charge curve axis coincides with the welded seam axis. Along the explosion charge axis, and implemented the same, there is placed an additional auxiliary explosive charge along the line or axis of the weld seam.

The degree of lowering remaining tensions is determined by increments of the periodic curve along which there is placed an explosive material charge.

In finishing thick-walled steel structures or materials of high strength it is necessary to considerably lower the amplitude of the curve forming the basis for the placement of the explosive charge. The explosion charge in the form of a periodic curve is made of an explosive stick formed of one or several parts. In this regard, if the ratio of the serial to the amplitude of the periodic curve equals or is lower than one interruption in detonation is possible because detonation products interrupt adjoining branches of the charge prior to being reached by the detonation wave front.

In order to avoid this and at the same time to increase efficiency, there is placed an additional explosive stick charge over the charge main thereby securing complete detonation of the main explosive charge.

The basic purpose in deforming the welded joint metal is reduction of remaining tensions in the weld system, which has been proven in the course of research involving detonation in form of a periodic curve.

The additional charge considerably increases efficiency and provides reliable detonation at any ratio of period and amplitude of the explosive main charge.

The proposed method makes possible essential improvement in reduction of remaining tensions in welded structures—primarily in thick—walled and large dimension structures at work sites.

In addition to full efficiency in reducing remaining tensions, there are implemented exceptional economic effects.

Practice has confirmed the proposed solution.

Same has been materialized in numerous structures of robust dimensions.

Reduction in remaining tensions due to welding in one decomposer tank of a diameter of 10 m., height of 36 m., wall thickness of 10–22 mm, as placed in utilization position on the work site, through a known thermal method costs incomparable more in comparison to the method of the present invention.

In addition to this, the suggested solution is very simple for practical implementation because there are in parallel decreased remaining welding tensions with assembly operations, which are finalized simultaneously.

We claim:

1. A method of reducing remaining tensions and corrosion resistance in welded joints by explosion finishing thereof, comprising disposing over the axis of the weld seam a main explosive charge in the form of a periodic curve, the axis of which is substantially co-extensive with that of the weld seam with the amplitude thereof extending from one side of said seam to the other, and then detonating said main explosive charge.

2. A method according to claim 1, wherein an auxiliary explosure charge is disposed over said main explosive charge.

* * * * *